United States Patent [19]

Matsuo et al.

[11] 4,301,369

[45] Nov. 17, 1981

[54] SEMICONDUCTOR ION EMITTER FOR MASS SPECTROMETRY

[75] Inventors: Takekiyo Matsuo, Toyonaka; Itsuo Katakuse, Minoo; Hisashi Matsuda, Takarazuka, all of Japan

[73] Assignee: The President of Osaka University, Osaka, Japan

[21] Appl. No.: 11,863

[22] Filed: Feb. 13, 1979

[30] Foreign Application Priority Data

Aug. 12, 1978 [JP] Japan ..... 53/98574

[51] Int. Cl.[3] ..... H01J 27/00

[52] U.S. Cl. ..... 250/423 R; 313/345; 428/607; 428/620; 428/664; 428/672

[58] Field of Search ..... 428/620, 611, 663, 665, 428/606, 607, 546, 664, 672; 313/309, 103 R, 230–232, 310, 328, 329, 345, 351, 500, 337; 250/423 R, 423 P, 423 F, 288

[56] References Cited

U.S. PATENT DOCUMENTS

| | | | |
|---|---|---|---|
| 3,457,478 | 7/1969 | Lehrer | 361/307 |
| 3,466,485 | 9/1969 | Arthur, Jr. et al. | 313/309 |
| 3,852,595 | 12/1974 | Aberth | 250/423 R |
| 3,998,678 | 12/1976 | Fukose et al. | 313/309 |
| 4,008,412 | 2/1977 | Yuito et al. | 313/309 |
| 4,099,986 | 7/1978 | Diepers | 428/620 |
| 4,163,918 | 8/1979 | Shelton | 313/309 |
| 4,175,234 | 11/1979 | Hunt et al. | 250/423 R |

OTHER PUBLICATIONS

Matsuo et al., "Field Desorption Mass Spectra of Tryptic Peptides of Human Hemoglobin Chains", *Biomedical Mass Spectrometry,* 6 pages (1981).

Burlingame et al., "Mass Spectrometry", *Anal. Chem.,* vol. 52, pp. 214R, 225R, 249R.

Matsuo, T. et al., "Use of Field Desorption Spectra . . . ", *Analytical Chemistry,* vol. 51, p. 1329 (7/79).

Matsuo, T. et al., "Silicon Emitter For Field Desorption Mass Spectrometry", *Analytical Chemistry,* vol. 51, p. 69 (1/79).

Beckey, H. D. et al., *Journal of Physics E,* vol. 6, Gr. Britain, 1973, pp. 1043, 1044.

*Primary Examiner*—Michael L. Lewis

*Attorney, Agent, or Firm*—Robert E. Burns; Emmanuel J. Lobato; Bruce L. Adams

[57] ABSTRACT

A semiconductor ion emitter for a mass spectrometer, comprises an electrode having semiconductor whiskers provided on the conductive surface of a base. A process for manufacturing such semiconductor ion emitter, includes steps of evaporating gold onto a wire having a diameter of about 60 μm, preheating the coated wire, and supplying a gas containing the semiconductor for growth of the whiskers on the gold plated wire. An apparatus for such process comprises a vacuum vessel for enclosing the wire, means for controllably heating the wire and means for controllably supplying a gas containing the semiconductor into the vacuum vessel.

10 Claims, 3 Drawing Figures

SEMICONDUCTOR ION EMITTER FOR MASS SPECTROMETRY

FIELD OF THE INVENTION

This invention relates to a semiconductor ion emitter for use in a mass spectrometer.

BACKGROUND OF THE INVENTION

Mass spectrometry is used widely in many fields, such as physics, chemistry, biology, medial science, pharmaceutics, agriculture, and engineering. Analysis of atoms, molecules and organic compounds by mass spectrometry first calls for ionization.

Conventionally, ionization has been accomplished mainly by use of an electron-impact type ion source. The impingement of electrons in this type of ion source, however, imparts many complex mass spectra to a specimen of organic compound as a result of fragmentation. Then it often becomes difficult to obtain a characteristic spectrum (especially for molecular ions) necessary for identification and structural analysis.

A solution proposed is field ionization (hereinafter called the FI method). This method employs an anode that consists of a metal wire on the surface of which conductive microneedles are grown and an opposite cathode disposed several millimeters away from the anode. A strong electric field is formed on the surface of the metal wire by applying a voltage of over 10 kv between the anode and the cathode.

On supplying a gasified organic compound specimen having a high vapor pressure, the metal surface absorbs electrons and causes ionization.

Because it emits ions, the metal wire having the conductive microneedles on its surface is called an ion emitter or emitter.

Another method proposed for ionizing a specimen with a low vapor pressure is ionization by field desorption (hereinafter called the FD method). According to this method, a liquefied or suspended specimen is put on a metal wire on which conductive microneedles are grown as in the case of the above-described FI method (which is also called an emitter).

The emitter is placed in an ion source as an anode, spaced approximately 2 mm away from an opposite cathode. An electric field of approximately $10^8$ v/cm is formed in the vicinity of the specimen on the conductive microneedles by applying a voltage of over 10 kv between the anode and the cathode. By the tunneling effect, the electrons in the specimen passes through the potential barrier distorted by the strong electric field to the metal wire. Then the remaining positive ions are taken away from the emitter by the electric field around the opposite cathode and enters the mass spectrometer to perform analysis.

The mass spectra thus produced by the FI and FD ionizing methods are suited for the determination of the molecular weight of a compound because they have strong molecular ion peaks and few peaks resulting from fragmentation.

As evident from the above description of the ionization mechanisms of the FI and FD methods, their ionization efficiency depends on the quality of the emitter.

A good emitter should have the following three properties:

(1) High ionization efficiency.

(2) Ability to hold much specimen.

(3) Adequate strength.

Most emitters have been prepared by growing graphitelike conductive microneedles on a tungsten wire, which has a diameter of approximately 10 μm and is heated to approximately 1200° C., by applying a high voltage of 10 to 14 kv to the wire in a stream of benzonitrile ($C_6H_5CN$) under reduced pressure. This type of emitter will be called a carbon emitter hereinafter.

In manufacturing, however, the tungsten wire needs careful pretreatment and such a long time as 5~10 hours is required in order to grow the microneedle crystals. Further, the 10 μm diameter tungsten wire with low mechanical strength easily breaks during use because of electrical shocks due to discharge and contact in putting a specimen thereon.

The object of this invention is to provide a semiconductor ion emitter which can be manufactured easily in a short time, has an adequate mechanical strength, can hold much specimen thereon, and assures high-efficiency ionization.

The semiconductor ion emitter according to this invention achieves this object by employing an electrode that comprises a number of semiconductor whiskers standing on the conductive peripheral surface of a wire having a diameter of about 60 μm.

Further, a process for manufacturing the semiconductor ion emitter according to this invention comprises the steps of evaporating gold onto the peripheral surface of a wire on which whiskers of a semiconductor are to be grown in a vacuum atmosphere, preheating the wire, supplying a gas containing the semiconductor at a regulated pressure so as to control the growth of the whiskers on the base, and heating the wire at a regulated temperature.

An apparatus for manufacturing the semiconductor ion emitter comprises a vacuum vessel to enclose in a vacuum atmosphere the wire on which whiskers of a semiconductor are to be grown, means for heating the wire in the vacuum vessel, the heating means having a temperature control function, and means for supplying a gas containing a semiconductor into the vacuum vessel, the gas supplying means communicating with the vacuum vessel through a control valve.

BRIEF DESCRIPTION OF THE DRAWINGS

Now a semiconductor emitter for ion sources that embodies this invention will be described by reference to the accompanying drawings, in which.

DESCRIPTION OF PREFERRED EMBODIMENTS

Figure 1:
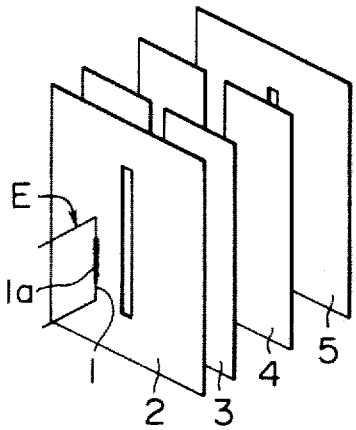
FIG. 1 is a persepective view that schematically shows how the emitter is disposed in the ion source.
Figure 1A:
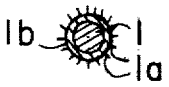
FIG. 1A is an enlarged cross schematic cross sectional view of the emitter and FIG. 2 is a block diagram of the emitter manufacturing equipment.

The semiconductor ion emitter E comprises a number of whiskers 1*a* of silicon, a semiconductor, standing on the peripheral conductive surface of a metal base that consists of a tungsten wire 1, with an evaporation layer of gold (1 lb) therebetween.

The manufacturing process of the semiconductor emitter E will be described by reference to FIG. 2. A 60 μm diameter tungsten wire 1 is spot-welded to the tip ends of two Kovar (trademark) wires 7, each 1 mm in diameter, which serve as a semiconductor emitter support. After evacuating this unit in a vacuum chamber 6, gold is evaporated to a thickness of several hundred angstroms where the silicon whiskers 1*a* are to be grown.

Then the unit is preheated for approximately 1 minute by passing a current (0.45 volt and 0.90 ampere) from a constant-voltage power supply 8 to the tungsten wire 1 that serves also as an electric heater.

A leak valve 11 is opened to supply a silane gas ($SiH_4$ 5%+Ar 95%) from a gas cylinder 12 to the vacuum chamber 6 until a pressure of 50 to 150 torr is established therein.

On supplying the current (0.45 volt and 0.90 ampere) again from the constant-voltage power supply 8 to the tungsten wire 1, a number of amorphous silicon whiskers 1*a*, approximately 20 μm and 0.2 μm in diameter each, grow in 1 to 10 minutes.

The time for growth of the whiskers 1*a* changes with the pressure of the silane gas. The length and diameter of the amorphous silicon whiskers 1*a* can be varied by changing the temperature by supplying different currents to the tungsten wire 1.

The semiconductor emitter E thus prepared is fitted to a field-ionization type or field-desorption type ion source as an electrode (anode) as shown in FIG. 1.

In FIG. 1, reference numeral 2 designates an electrode (cathode) disposed opposite to the semiconductor emitter E. Reference numerals 3 and 4 denote lens electrodes, and 5 a main slit.

Figure 2:
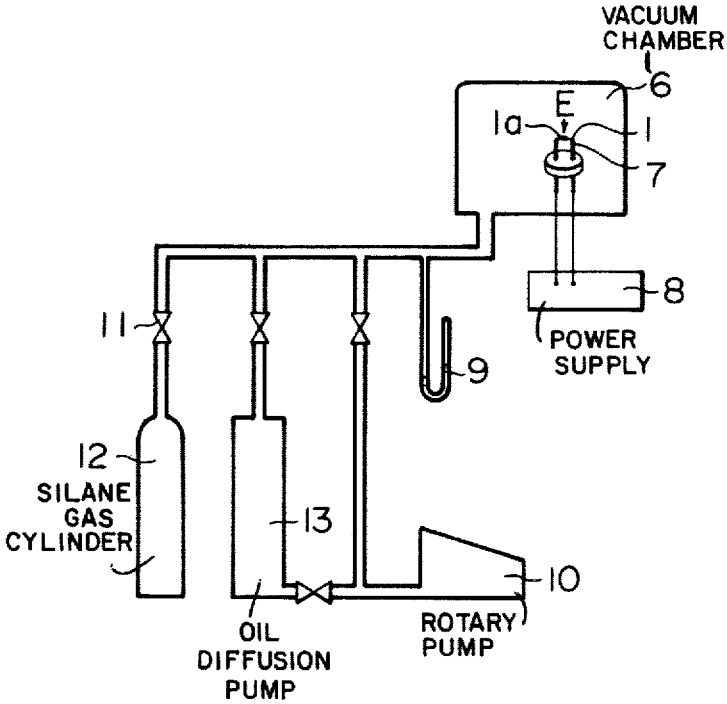

In FIG. 2, reference numeral 9 designates a pressure gauge, 10 a rotary pump, and 13 an oil diffusion pump.

The properties (1) to (3), previously described, of the semiconductor emitter E according to this invention were experimentally checked as follows:

(1) Ionization efficiency. The FI method applied to acetone resulted in an ionization rate of $5\times10^{-6}$ A/torr.

Ionization rates of the FD method with cholesterol and oligopeptide specimens were $1.1\times10^{-10}$ coulomb/μg and $2.2\times10^{-11}$ coulomb/μg, respectively. These values are higher than the ionization rates of the conventional carbon emitters for ion sources.

(2) Specimen holding capacity. Evidently, a 60 μm diameter semiconductor emitter E can hold much more specimen than a conventional carbon emitter that is 10 μm in diameter.

(3) Strength. This property should be studied from the chemical and mechanical viewpoints.

Chemically, the semiconductor emitter E exhibited no marked deterioration in an acid and a basic solution.

Mechanically, the 60 μm diameter tungsten wires 1 proved to have adequate strength, with none of the several hundred wires tested having broken.

For the metal base, a tantalum or other suitable wire may be used in place of the tungsten wire in the above-described embodiment.

Further, the metal wire may be supplanted by one of such semiconductors as silicon and germanium and such nonmetallic materials as glass and synthetic resin covered with metal coating.

The metal-coated nonmetallic wire has an advantage of high workability.

The whiskers of such semiconductors as silicon and germanium can be grown on the surface of the semiconductor or the metal coating of the nonmetallic wire according to procedures similar to the above-described one. Their operations and results have been confirmed empirically.

As evident from the above description, the semiconductor ion emitter according to this invention works as a very effective ion emitter for mass spectrometry.

What is claimed is

1. Ion emitter for mass spectrometry comprising a wire having a diameter of approximately 60 μm and having a conductive metal peripheral surface, and a multiplicity of whiskers of semiconductor material projecting from said conductive metal peripheral surface of said wire.

2. Ion emitter according to claim 1, in which said whiskers have a length of approximately 20 μm and a diameter of approximately 0.2 μm.

3. Ion emitter according to claim 1, in which said peripheral surface of said wire comprises a gold layer.

4. Ion emitter according to any of claims 1 to 3, in which said wire is metal.

5. Ion emitter according to claim 4, in which the metal of said wire is selected from the group consisting of tungsten and tantalum.

6. Ion emitter according to claim 3, in which said wire is of semiconductor material coated with said gold layer.

7. Ion emitter according to claim 6, in which said semiconductor material of said wire is selected from the group consisting of silicon and germanium.

8. Ion emitter according to claim 3, in which said wire is of insulating material coated with said gold layer.

9. Ion emitter according to claim 8, in which said insulating material of said wire is selected from the group consisting of glass and synthetic resin.

10. Ion emitter according to claim 1 or 2, in which said wire is welded to the tips of two other wires of larger diameter serving as a support and electrical connectors.

* * * * *